US007300055B2

(12) United States Patent
Mukai

(10) Patent No.: US 7,300,055 B2
(45) Date of Patent: Nov. 27, 2007

(54) IMAGE FORMING APPARATUS

(75) Inventor: Kenichi Mukai, Chuo-ku (JP)

(73) Assignee: Kyocera Mita Corporation, Osaka (JP)

( * ) Notice: Subject to any disclaimer, the term of this patent is extended or adjusted under 35 U.S.C. 154(b) by 290 days.

(21) Appl. No.: 10/825,620

(22) Filed: Apr. 16, 2004

(65) Prior Publication Data

US 2005/0001374 A1 Jan. 6, 2005

(30) Foreign Application Priority Data

Apr. 17, 2003 (JP) ..... 2003-113185

(51) Int. Cl.
*B65H 5/06* (2006.01)

(52) U.S. Cl. ..... 271/272

(58) Field of Classification Search ..... 198/608, 198/624; 271/272–274, 264, 109, 188; 492/7, 492/16, 20, 53, 54, 56–59
See application file for complete search history.

(56) References Cited

U.S. PATENT DOCUMENTS 3,467,009 A * 9/1969 Ross ..... 101/216
3,622,059 A * 11/1971 Savela ..... 226/190
3,788,638 A * 1/1974 Lehmann ..... 271/272
4,188,025 A * 2/1980 Gusfafson et al. ..... 271/314
4,287,409 A * 9/1981 Auchinleck ..... 235/475
4,640,409 A * 2/1987 Holtman ..... 198/624
4,826,383 A * 5/1989 Millen ..... 414/789.9
5,193,800 A * 3/1993 Kashiwabara ..... 271/272
5,201,424 A * 4/1993 Hain ..... 209/534
5,209,466 A * 5/1993 Watts et al. ..... 271/188
5,270,778 A * 12/1993 Wyer ..... 399/406
5,553,541 A * 9/1996 Vrotacoe et al. ..... 101/217
5,725,208 A * 3/1998 Miyauchi ..... 271/10.09
5,915,691 A * 6/1999 Deguchi et al. ..... 271/265.01

(Continued)

FOREIGN PATENT DOCUMENTS

JP 62275943 A * 11/1987

(Continued)

*Primary Examiner*—Patrick Mackey
*Assistant Examiner*—Jeremy R Severson
(74) *Attorney, Agent, or Firm*—Crowell & Moring LLP

(57) ABSTRACT

The object is to provide an image forming apparatus in which the copy sheet can be transferred with stable velocity and high accuracy even if there is variation in diameter due to machining tolerance. A pair of roller for feeding copy sheet pinching the sheet between the rollers consists of a rigid roller and an elastic roller which is pressed against the rigid roller, and both the rollers are connected by means of a driving mechanism so that the peripheral velocity of both the rollers are essentially equal. The diameter of said elastic roller is determined in the range between the first diameter with which the peripheral velocity of said elastic roller at the depressed part depressed due to the pressing of the elastic roller against the rigid roller without the copy sheet between the rollers coincides with the peripheral velocity of said rigid roller and the second diameter with which the peripheral velocity of the rigid roller assumed to have a diameter increased by the thickness of the copy sheet (rigid roller with increase diameter) coincides with the peripheral velocity of the elastic roller at the depressed part depressed due to the pressing of the elastic roller against said rigid roller with increased diameter without the copy sheet between the rollers.

4 Claims, 4 Drawing Sheets

U.S. PATENT DOCUMENTS

| | | | | |
|---|---|---|---|---|
| 5,927,709 | A * | 7/1999 | Greive | 271/188 |
| 5,934,663 | A * | 8/1999 | Saito et al. | 271/109 |
| 6,028,148 | A * | 2/2000 | Miyabayashi | 525/478 |
| 6,032,945 | A * | 3/2000 | Miura | 271/122 |
| 6,135,448 | A * | 10/2000 | Daito | 271/270 |
| 6,193,232 | B1 * | 2/2001 | Regimbal et al. | 271/272 |
| 6,314,268 | B1 * | 11/2001 | Giunta et al. | 399/406 |
| 6,374,734 | B1 * | 4/2002 | Gaffney et al. | 101/376 |
| 6,393,247 | B1 * | 5/2002 | Chen et al. | 399/330 |
| 6,446,954 | B1 * | 9/2002 | Lim et al. | 271/10.04 |
| 6,463,250 | B1 * | 10/2002 | Chen et al. | 399/330 |
| 6,499,586 | B2 * | 12/2002 | Furusawa et al. | 198/781.02 |
| 6,668,711 | B1 * | 12/2003 | Villiger | 100/41 |
| 6,719,286 | B1 * | 4/2004 | Ohyama et al. | 271/119 |
| 2002/0113364 | A1 * | 8/2002 | Hsieh et al. | 271/272 |
| 2002/0165075 | A1 * | 11/2002 | Shea et al. | 492/56 |
| 2003/0083180 | A1 * | 5/2003 | Sato et al. | 492/47 |
| 2004/0012143 | A1 * | 1/2004 | Yamamoto | 271/272 |
| 2004/0251618 | A1 * | 12/2004 | Niizeki | 271/272 |
| 2005/0119097 | A1 * | 6/2005 | Nishimori | 492/56 |
| 2005/0161877 | A1 * | 7/2005 | Sumi | 271/272 |
| 2005/0263958 | A1 * | 12/2005 | Knierim et al. | 271/272 |
| 2006/0071421 | A1 * | 4/2006 | Itoh | 271/272 |

FOREIGN PATENT DOCUMENTS

| | | | |
|---|---|---|---|
| JP | 05162916 | A * | 6/1993 |
| JP | 5270692 | | 10/1993 |
| JP | 2000-351470 | | 12/2000 |
| JP | 2001-166607 | | 6/2001 |

* cited by examiner

IMAGE FORMING APPARATUS

BACKGROUND OF THE INVENTION

1. Field of the Invention

The present invention is related to an image forming apparatus such as a copying machine, printer, facsimile machine, and combined machine of them using electrophotographic process, specifically to an image forming apparatus having a pair of transfer rollers consisting of a rigid roller and an elastic roller pinching the copy sheet between them for transferring it.

2. Description of the Related Art

In a copying machine, printer, facsimile machine, or combined machine of them using electrophotographic process, high accuracy is required for the feeding velocity of a copy sheet transferred by means of transfer rollers, for the feeding velocity of the copy sheet influences directly the magnification, etc. of the image to be transferred to the copy sheet from the image carrying body such as a photoreceptor.

Particularly, high accuracy is required to a pair of registration rollers for adjusting the position of the copy sheet fed from the paper feeder cassette and allow the sheet to advance to the image transfer position synchronizing with the timing of image formation by carrying body such as a photoreceptor, since the feed velocity of the copy sheet directly influences the quality of image. There has been adopted a method, in which an elastic roller having a rubber surface of hardness of about, for example, JIS-A 65°~90° on its periphery is pressed to a rigid roller made of metal or having resin material on its periphery, the rollers are connected by means of gear wheels to transmit driving force from one of the roller to the other, and the copy sheet is pinched between the rollers in order to achieve the feeding of copy sheet with stable velocity and allowance for the variation in feeding load.

In this case, as the rigid roller and elastic roller are connected with gear wheels, the diameter of each roller is determined so that the peripheral velocities of both the rollers coincide with each other in consideration of the gear ratio. The diameters of this state are hereafter referred to as equal-velocity diameters. If the diameters deviate from the equal-velocity diameters, there occurs a slip between the rollers. However, there is inevitably variation in the diameter of each roller due to machining tolerance of diameter. Particularly, the tolerance of the diameter of the elastic roller having rubber material on its periphery is larger than that of the rigid roller owing to machining condition. Therefore, there has been a problem that the feeding velocity of copy sheet is largely influenced by the diameter of the elastic roller and feeding of the copy sheet with stable velocity can not be secured.

For feeding the copy sheet accurately with stable velocity, an image forming apparatus used for copying images onto a variety of kinds and sizes of copy sheets is disclosed, for example, in Japanese Laid-Open Patent Application No. 2001-166607 (hereafter referred to as Patent literature 1). An image forming apparatus had been disclosed, in which a pair of preliminary feed rollers was additionally provided between the registration rollers and the image transfer position with a sensor for detecting the leading edge of the copy sheet provided downstream of the registration rollers before the pair of preliminary feed rollers, because it was difficult for a pair of registration rollers, which consists of a driving roller and a follower roller and feeds the copy sheet to the image transfer position in synchronization with the timing of toner image formation on an image carrier device such as a photoreceptor, to feed various kinds of copy sheets with the accuracy of position required. The patent literature 1 teaches that even with the mechanism described above it became difficult to attain required accuracy. To deal with this and with the variation in copy sheet transfer performance due to the wear of the transfer rollers by the use over a long period of time, the patent literature 1 proposed to divide the guide member for guiding the copy sheet to the image transfer position into two, each for the pair of registration rollers and for the pair of preliminary feed rollers, the relative position of these guide members being able to be adjusted, and to compose the driving roller of the pair of preliminary feed rollers with wear-resistant material.

Further, in Japanese Laid-Open Patent Application No. 2000-351470 (hereafter referred to as Patent literature 2) is disclosed an image forming apparatus, in which the transfer rollers of an ink-jet printer is composed of a roller having hard material on the periphery thereof and a roller having material of high friction coefficient such as rubber on the periphery thereof, the latter rubber roller is divided in the direction of axis thereof such that guide rollers each having a diameter smaller than that of the central roller and hardness harder than that of the central roller are provided to the both side of the central roller in order to keep the accuracy of copy sheet transfer irrespective of the thickness and size of the sheet. With the configuration of the rubber roller like this, the both side parts of the rubber roller are prevented from being excessively deformed by virtue of the guide rollers, which prevents the sheet from advancing obliquely when a sheet large in thickness but small in width is fed.

Further, in Japanese Patent No. 3140152 (hereafter referred to as Patent literature 3) is disclosed an image forming apparatus, in which sheet feeing mechanism is composed so that the transfer distance per step of the stepping motor of each pair of rollers are different in order to prevent the occurrence of resonance of two pairs of rollers which induces noisy occurrence and affects the feeding performance.

However, the sheet transfer mechanism disclosed in patent literature 1 is composed of a driving roller and a follower roller not that both the rollers are connected by gear wheels. Further, as a sensor for detecting the leading edge of copy sheet is provided downstream from a pair of registration rollers and a pair of preliminary feed rollers is provided between said pair of registration rollers and image transfer position, the mechanism is complicated resulting in higher cost. The disclosure of patent literature 2 is an art to prevent oblique advancing of the copy sheet when feeding the sheet which is thick but small in width and can not solve the problem of the fluctuation of sheet feeding velocity due to the variations of the diameters of the rollers. The disclosure of patent literature 3 is an art of preventing mainly noisy occurrence due to the resonance of two pairs of rollers located at different positions and contributes little to increase the accuracy of feeding the copy sheet.

Accordingly, the object of the present invention is to provide a pair of rollers for feeding copy sheet, the pair of rollers being composed of an elastic roller pressed against a rigid roller and driven by means of a driving mechanism to feed the sheet pinching it between the rollers, composed such that the copy sheet can be fed with stable velocity and high accuracy, even if there are variations in diameters of the rollers due to machining tolerance, with simple construction and low cost for an image forming apparatus.

SUMMARY OF THE INVENTION

To solve the problem mentioned above, the present invention proposes an image forming apparatus having a pair of rollers for transferring a copy sheet pinching it between the rollers, wherein said pair of rollers consists of a rigid roller and an elastic roller pressed against said rigid roller, the rollers being connected to a driving mechanism composed so that the peripheral velocities of both the rollers are approximately equal, and the diameter of said elastic roller is determined in the range between such first diameter that the peripheral velocity of said elastic roller at the part depressed due to the pressing of the elastic roller against the rigid roller without the copy sheet between the rollers coincides with the peripheral velocity of said rigid roller and such second diameter that the peripheral velocity of the rigid roller assumed to have a diameter increased by the thickness of the copy sheet (rigid roller with increased diameter) coincides with the peripheral velocity of the elastic roller at the part depressed due to the pressing of the elastic roller against said rigid roller with increased diameter without the copy sheet between the rollers. The peripheral velocity at the depressed part means the peripheral velocity at the center of the depression, where the rollers contribute to transfer the sheet most in the depression When the diameter of the elastic roller is between said first diameter and second diameter, there occurs a phenomenon like that the copy sheet winds itself around the rigid roller in the depression caused by the pressing of the elastic roller against the rigid roller resulting in the state as if the diameter of the rigid roller is increased in effect owing to the thickness of the sheet and accordingly the peripheral velocity of the rigid roller is increased. In the range of the diameter of elastic roller between the first diameter and the second diameter, the increase of the sheet feeding velocity with increasing diameter of the elastic roller is conspicuously smaller than that of the diameter of elastic roller in the range of between the first diameter and the second diameter. For this reason, by determining the diameter of the elastic roller in the range of the first diameter and the second diameter, the change of the feed velocity of the sheet with the change in the diameter of the elastic roller is small and the sheet can be fed with stable velocity and high accuracy.

By determining the medial design diameter of said elastic roller to be about mid-value between the first and second diameter, the copy sheet can be fed with stable velocity and high accuracy regardless of the variation in diameters of the rollers particularly in the diameter of the elastic roller due to machining tolerance, because the variation has small effect on the feed velocity of the sheet in the range in which the change of the sheet feeding velocity with the change in the diameter of the elastic roller is slow.

It is suitable that said elastic roller is a roller having rubber of hardness of JIS-A Hs65 to 90, preferably Hs70 to 80 wound around the periphery thereof. Further, it is preferable that, said first diameter is 1.005 times the diameter of the elastic roller before correction and said second diameter is 1.012 times the diameter of the elastic roller before correction when the effective diameter of the elastic roller in the operating condition decreases by 0.5% due to the pressing of the elastic roller against the rigid roller.

DETAILED DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
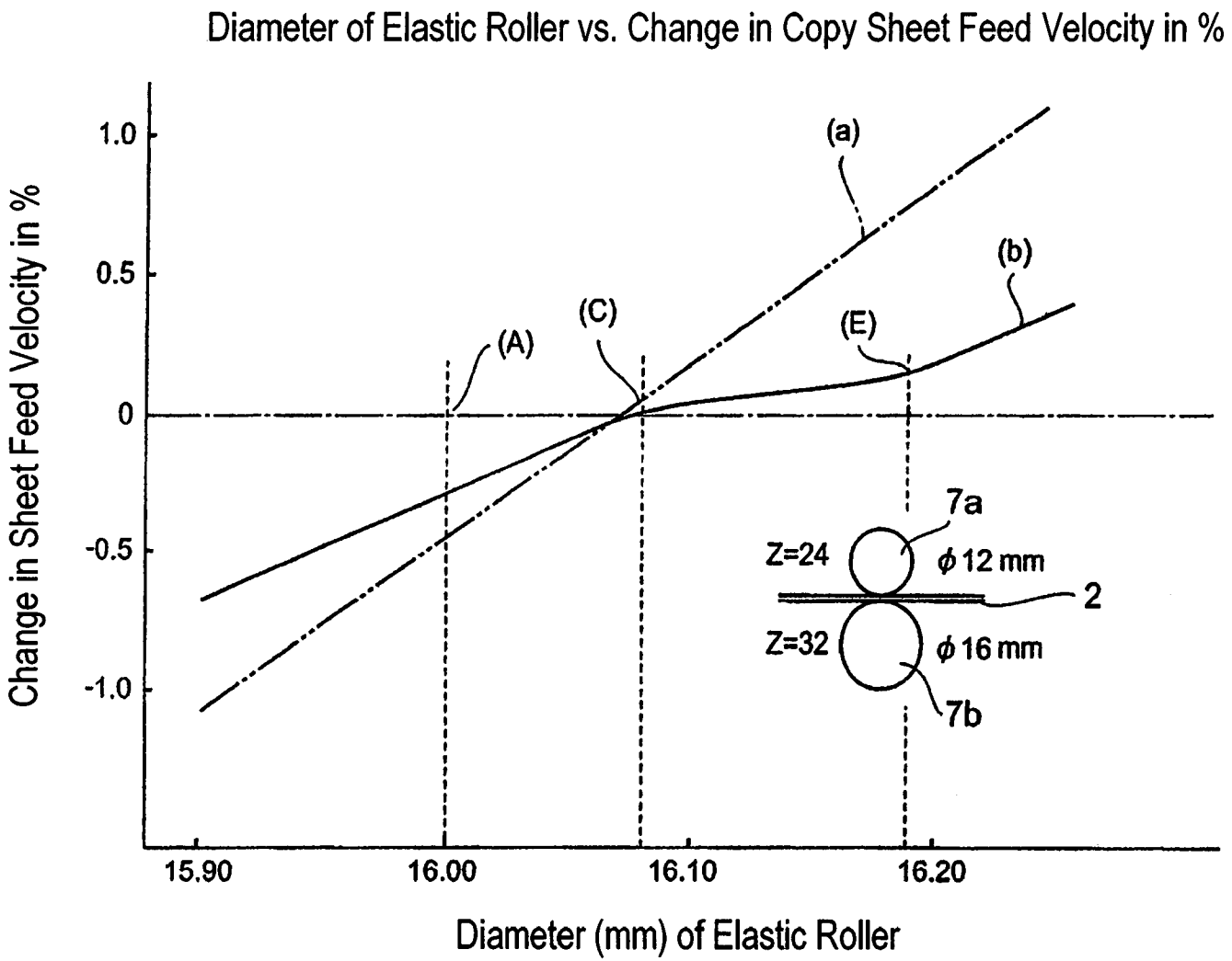
FIG. 1 is a graph showing the change in copy sheet feed velocity in % vs. the diameter of the elastic roller of a pair of sheet transfer rollers of the image forming apparatus according to the present invention.
Figure 2:
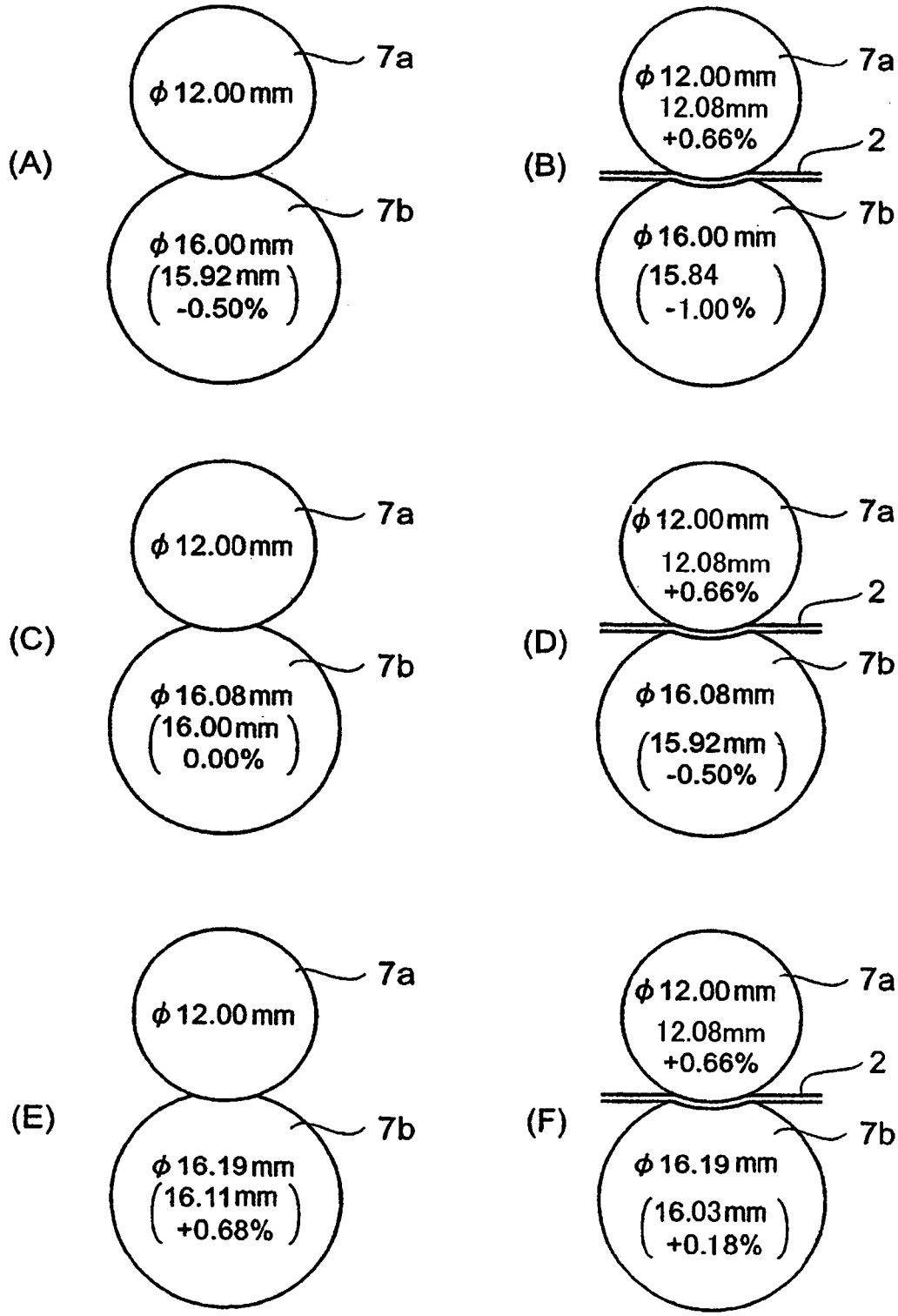
FIG. 2 is a conceptual illustration for explaining the change in sheet feed velocity and the compensation of diameter of the elastic roller of a pair of sheet transfer rollers of the image forming apparatus according to the present invention.
Figure 3:
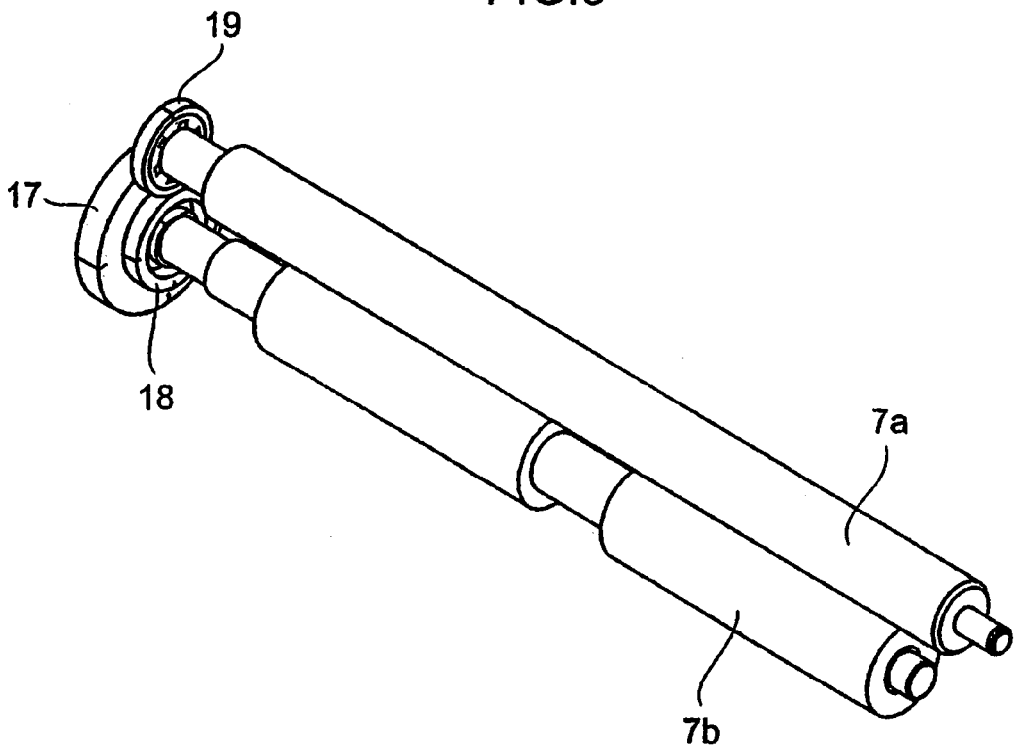
FIG. 3 is a perspective view showing an example of the configuration of a pair of sheet transfer rollers of the image forming apparatus according to the present invention.
Figure 4:
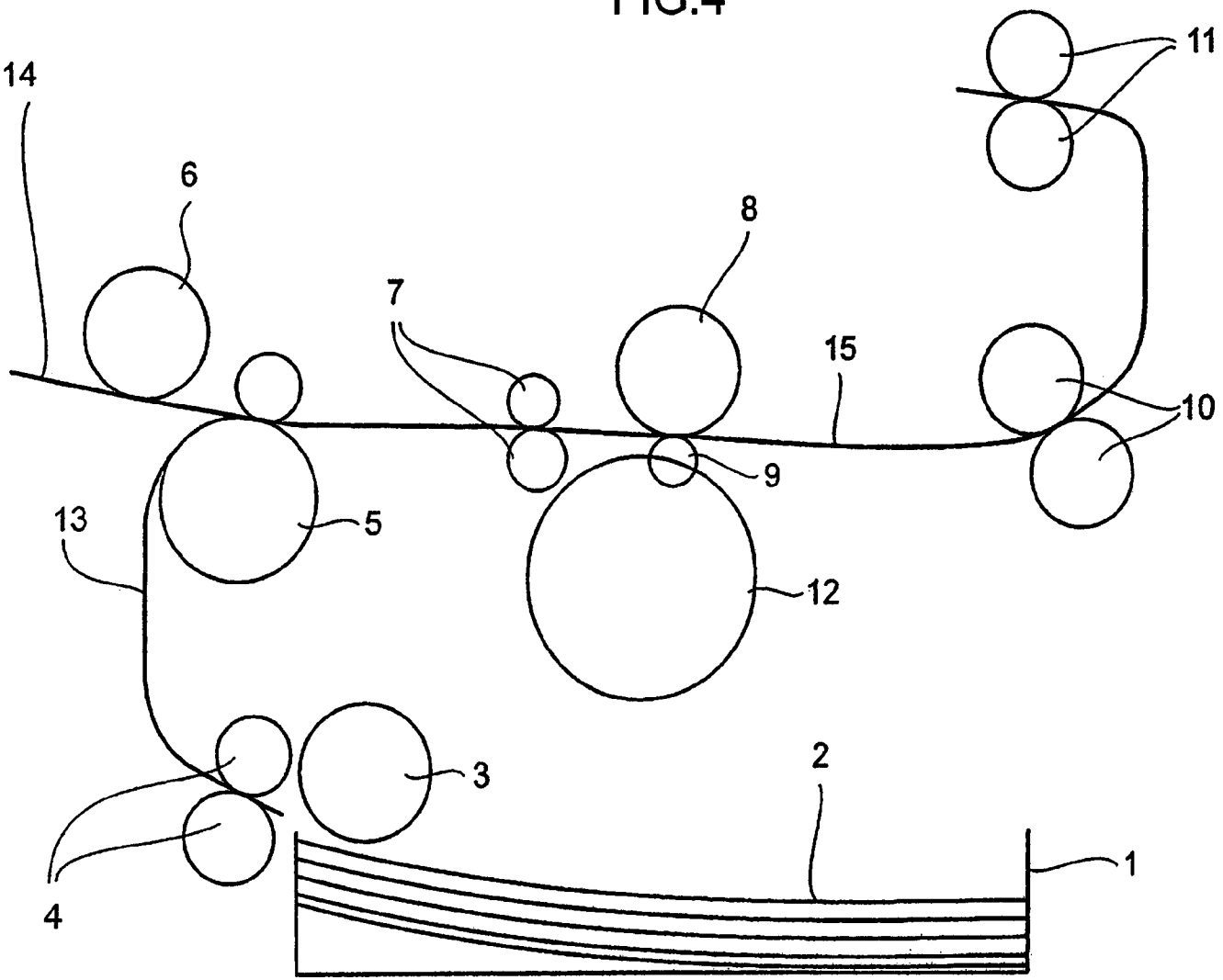
FIG. 4 is a conceptual illustration for explaining the main components and transfer path of the image forming apparatus according to the present invention.

FIG. 1 is a graph showing the change in copy sheet feed velocity in % vs. the diameter of the elastic roller of a pair of sheet transfer rollers of the image forming apparatus according to the present invention, FIG. 2 is a conceptual illustration for explaining the change in copy sheet feed velocity and the compensation of diameter of the elastic roller of a pair of sheet transfer rollers of the image forming apparatus according to the present invention, FIG. 3 is a perspective view showing an example of the configuration of a pair of sheet transfer rollers of the image forming apparatus according to the present invention, and FIG. 4 is a conceptual illustration for explaining the main components and transfer path of the image forming apparatus according to the present invention.

Referring to FIG. 4, reference numeral 1 is a paper feeder cassette accommodating copy sheets 2, 3 is a pick up roller for picking up and feeding copy sheets 2, 4 is a pair of separation/feed rollers for positively picking up the copy sheet one by one and sends it to the transfer path thereof, 5 is a pair of intermediate rollers, 6 is a second feed roller for sending the copy sheet placed on a manually feeding section, 7 is a pair of registration rollers for correcting the positioning of the sheet reached there and sending out toward an image transfer position synchronizing with the timing of toner image formation on a photoreceptor 8. The pair of registration rollers 7 consist of, for example, a rigid roller such as a roller made of metal or a roller with resin material wound on the periphery thereof and an elastic roller with rubber material of hardness of JIS-A Hs 65~90, preferably Hs70~80 wound on the periphery thereof as shown in FIG. 3. Reference numeral 8 is a photoreceptor (image carrier device), 9 is an image transfer roller, 10 is a pair of fusing rollers, 11 is a pair of ejecting rollers, 12 is a motor for driving the pick up roller 3, intermediate rollers 5, second feed roller 6, registration rollers 7, photoreceptor (image carrier device) 8, fusing rollers 10, ejecting rollers 11, etc. Reference numeral 13 is a sheet transfer path from the paper feeder cassette 1, 14 is a manual feed path from the manually feeding part, 15 is a transfer path from the intermediate rollers 5 until the ejecting rollers 11. In FIG. 3, reference numeral 17 is a gear wheel to which is transmitted the driving force of the motor 12 to drive the elastic roller 7*b*, 18 is a gear wheel attached to the shaft of the elastic roller 7*b* concentrically with the gear wheel 17 to transmit driving force to a gear wheel 19 attached to the rigid roller 7*a*. The ratio of number of teeth of the gear wheels 18 and 19 is determined so that the peripheral velocity of the rigid roller 7*a* coincides with that of the elastic roller 7*b*.

The pick up roller 3, intermediate rollers 5, second feed roller 6, and registration rollers 7 compose a sheet feeding line, an electrostatic charger, the opening part of a light exposure device, developing device, cleaning blade (cleaning means), etc. not shown in the drawing are provided around the photoreceptor 8 to compose a processing unit. The fusing rollers 10 and ejecting rollers 11 composes a fusing/ejecting line. Further, transfer guides and rollers not shown in the drawing are provided between the separation/feed rollers 4 and intermediate rollers 5, between the intermediate rollers 5 and registration rollers 7, between the photoreceptor 8 and fusing rollers 10, and between the fusing rollers 10 and ejecting rollers 11. The processing unit includes not necessarily all of the photoreceptor (image carrier device), electrostatic charger, light-disposing opening, developer, cleaning blade, etc., the unit may include at least the photoreceptor (image carrier device), light-disposing opening, and developer. The unit may be integrated with these components.

Before explaining the present invention, the position of the copy sheet transfer rollers and the process of image formation will be explained referring to FIG. 4. Upon receiving an instruction signal to form an image from a controller not shown in the drawing, the photoreceptor 8 etc, are driven by the motor 12, the photoreceptor 8 is charged evenly by a charging device not shown in the drawing, the photoreceptor 8 is exposed to the light from a disposure device not shown in the drawing to have a latent image formed thereon, and the latent image is developed by means of a developer not shown in the drawing to have a toner image formed thereon. On the other hand, a copy sheet 2 is picked up by the pick up roller 3 from the paper feeder cassette 1 accommodating copy sheets 2 therein to be transferred to the intermediate rollers 5 by means of the separation/feed rollers 4, and the sheet is further transferred to the registration rollers 7. The sheet is fed by the registration rollers 7 to the image transfer position in synchronization with the timing the toner image is formed on the photoreceptor 8, where the toner image on the photoreceptor 8 is transferred to the copy sheet by means of the image transfer roller 9 applied with bias voltage. The copy sheet 2 onto which the toner image is transferred is transferred to the fusing rollers 10 to have the toner image permanently affixed thereto and then ejected by means of the ejecting rollers 11. In the image forming apparatus shown in FIG. 4, the separation/feed rollers 4, registration rollers 7, ejecting rollers 11, etc. are sheet transfer roller pairs. Although in the following explanation the pair of registration rollers 7 will be taken up as an example, it is evident that the present invention can be applied to any pair of transfer rollers consisting of a rigid roller and an elastic roller connected with gear wheels to each other regardless of where it is positioned.

Among the sheet transfer rollers, the pair of registration rollers 7 functions to feed the copy sheet to the image transfer position in synchronization with the timing of the formation of the toner image on the photoreceptor 8 in order to have the toner image accurately transferred onto the sheet, so that the feeding velocity of the sheet directly influences the quality of the transferred image. Therefore, high accuracy is required to the feeding velocity. The pair of the registration rollers 7 consists of, for example, a rigid roller such as a roller made of metal or a roller with resin material wound on the periphery thereof and an elastic roller with rubber material of hardness of JIS-A Hs 65~90, preferably Hs70~80 wound on the periphery thereof in order to secure feeding force, further the gear wheel 17 for transmitting the driving force of the driving motor 12 to the elastic roller 7*b* is attached to the shaft of the elastic roller 7*b*, and the gear wheels 18, which is attached coaxially with the gear wheel 17, and 19 are attached to the shafts of the elastic roller 7*b* and rigid roller 7*a* respectively to connect the elastic roller 7*b* to the rigid roller 7*a* with the ratio of the number of teeth determined so that the peripheral velocity of the elastic roller 7*b* coincides with that of the rigid roller 7*a* in order to achieve the feeding of copy sheet with stable velocity and allowance for the variation in feeding load. The hardness according to JIS-A of the rubber of the elastic roller 7*b* used for the registration roller 7 is preferably in a range of Hs65 to 90. If the hardness is higher than Hs90, it becomes difficult to produce the rubber roller and also the nipping of the sheet at the nip between the rollers becomes difficult, and if the hardness is lower than Hs65, the rubber roller wears excessively.

Lets think the case in which the pair of registration rollers 7 consists of a rigid roller 7*a* of diameter of 12 mm made of metal and an elastic roller 7*b* of diameter of 16 mm with rubber which have hardness mentioned above wound on the periphery thereof, both the rollers are connected to each other by the gear wheels 18 and 19 attached respectively to shaft of the elastic roller 7*b* and to the shaft of the rigid roller 7*a* with the ratio of the number of teeth of 32 to 24 so that the peripheral velocities of both of the rollers are about equal and the elastic roller 7*b* is pressed against the rigid roller 7*a* so that the elastic roller 7*b* is depressed by about 0.5% of the radius thereof at the part contacting with the rigid roller 7*a*. The copy sheet 2 is pinched between the rigid roller 7*a* and elastic roller 7*b*. As the rigid roller 7*a* and elastic roller 7*b* are connected by the gear wheels 18 and 19, a slip occurs between both the rollers when their diameters are not in the state of equal-velocity diameters, that is, the state the peripheral velocities on both the rollers do not just coincide with each other.

However, actually the diameter of the rollers varies due to machining tolerance, and particularly the machining tolerance of the elastic roller 7*b* with rubber wound on the periphery thereof is inevitably larger than that of the rigid roller 7*a*. For example, the tolerance of the diameter of the elastic roller of 16 mm diameter is about ±0.05 mm. Accordingly, the diameter of the elastic roller 7*b* varies between 15.95 and 16.05 mm, and the peripheral velocity varies between 99.7% and 100.3% of the reference value which is the peripheral velocity when the diameter is exactly 16 mm. This means that the peripheral velocity of the elastic roller 7*b* varies by 0.6% with a change of its diameter of 0.1 mm. Since the elastic roller 7*b* is pressed against the rigid roller 7*a* so that the elastic roller 7*b* is depressed by about 0.5% of the radius thereof at the part contacting with the rigid roller 7*a* as described above, the effective diameter of the elastic roller 7*b* of diameter of 16 mm is reduced to 15.92 mm and the peripheral velocity is reduced by 0.5% as shown in parentheses in FIG. 2(A). As explained later, the thickness of the paper is neglected in FIGS. 2(A), (C), and (E).

The graph shown in FIG. 1 is a result of measurement of the transferring velocity of the sheet fed by the rollers by varying the diameter of the elastic roller 7*b* using a sheet of thickness of about 0.08 mm generally used as a copy sheet. In this experiment, the rigid roller 7*a* of diameter of 12 mm was made of SUM22 and the diameter of the elastic roller 7*b* with EPDM of hardness of JIS-A Hs 80 wound on the periphery thereof was varied around 16 mm, and the number of teeth of the gear wheel 18 was 32 and that of the gear wheel 19 was 24. In FIG. 1, the abscissa is the diameter in mm of the elastic roller 7*b* when the elastic roller 7*b* doesn't contact with the rigid roller 7*a* and the ordinate is the ratio of sheet feed velocity to that of the reference velocity which coincides with the peripheral velocity of the elastic roller when its diameter is 16 mm and expressed in % increase/decrease. The horizontal line at zero velocity change indicates when the peripheral velocity of the rigid roller 7*a* and that of the elastic roller 7*b* is equal. The inclined straight line (a) represents the theoretical change of velocity with the change of the diameter of the elastic roller 7*b*, and curve (b) represents the result of measurement. Point (A) corresponds to the diameter of the elastic roller 7*b* of 16 mm when the peripheral velocity of the rigid roller 7*a* and that of the elastic roller 7*b* is theoretically equal, but the effective diameter of the elastic roller 7*b* is smaller than 16 mm due to the depression caused by the pressing of it against the rigid roller, as a result the diameter of the elastic roller 7*b* when the peripheral velocity of it at the part contacting with the rigid roller 7*a* coincide with that of the rigid roller 7*a* is 16.08 mm as shown in FIG. 2(C).

As recognized from the graph of FIG. 1, the measured velocity deviation ratio curve (b) approaches with a gradient smaller than that of the theoretical line (a) to point (C) where the nominal diameter of the elastic roller 7*b* is about 16.08 mm and the peripheral velocities of both the rollers are equal and then the inclination decreases from there until point (E) where the nominal diameter of the elastic roller 7*b* is about 16.19 mm. From here the inclination of the measured curve(b) again increases but the gradient is not larger than that of the theoretical curve(a). The reason of this phenomenon is thought that, as the elastic roller is pressed against the rigid roller, the part of the elastic roller 7*b* contacting with the rigid roller 7*a* is somewhat depressed. When the peripheral velocity of the elastic roller 7*b* and that of the rigid roller 7*a* is equal, the sheet is transferred at that peripheral velocity, but when the peripheral velocity of the elastic roller 7*b* increases, that is, when the diameter of the elastic roller 7*b* is a little larger, there occurs a phenomenon like that the sheet 2 winds itself around the rigid roller 7*a* resulting in a larger diameter of the rigid roller 7*a* in effect owing to the thickness of the sheet, therefore the difference between the peripheral velocity of the rigid roller 7*a* and elastic roller 7*b* does not increases.

In FIG. 2, the thickness of the paper being neglected, (A), (C), and (E) show the effect of the depression on the peripheral part of the elastic roller 7*b* contacting with the rigid roller 7*a* in the case the sheet is not fed between the rollers. (A) shows the case the diameter of the elastic roller 7*b* is 16 mm with which the theoretical peripheral velocities of both the rollers are equal, but when the effective diameter of the elastic roller 7*b* is reduced by 0.08 to 15.92 mm as shown in the parentheses due to the depression, the peripheral velocity of the elastic roller 7*b* at the depression is reduced by 0.50% compared to the peripheral velocity of the rigid roller 7*a* as shown in the parentheses. (C) shows the case the diameter of the elastic roller is 16.08 mm and its effective diameter is reduced to 16.00 mm as shown in the parentheses due to the depression and the peripheral velocity of the elastic roller 7*b* at the depression is equal to that of the rigid roller 7*a*. (E) shows the case the diameter of the elastic roller 7*b* is 16.19 mm which corresponds to the diameter at point (E) in FIG. 1 and its effective diameter is reduced to 16.11 mm due to the depression and the peripheral velocity of the elastic roller 7*b* at the depression is increased by 0.68% compared to the peripheral velocity of the rigid roller 7*a*.

FIGS. 2(B), (D), and (F) illustrate the case the sheet is fed between the rollers, in which the diameter of the rigid roller 7*a* is 12 mm but its effective diameter is supposed to be 12.08 mm as shown in the parentheses due to the effect of the winding of the sheet on the rigid roller 7*a*(This means that the effective radius is increased by a half of the thickness of the sheet.) and the effective peripheral velocity of the rigid roller is increased by 0.66% as shown in the parentheses, and as to the elastic roller, the diameter of which the radius is the length from the center of the elastic roller 7*b* to the center of the thickness of the sheet and the rate of increase/decrease of the peripheral velocity at that diameter are shown in the parentheses for each case of the diameter of the elastic roller 7*b* of 16.00 mm, 16.08 mm, and 16.19 mm respectively in (B), (D), and (F).

As can be recognized in FIG. 2, the outer diameter of the elastic roller at point (E) in FIG. 1 where the measurement curve (b) begins to rise with an increased gradient, is about 16.19 mm of which the corresponding effective diameter of the elastic roller 7*b* is reduced to 16.11 mm as shown in FIG. 2(E) in the parentheses due to the pressing of the rigid roller 7*a* to the elastic roller 7*b* and the effective peripheral velocity is increased by 0.68% compared to the case of FIG. 2(C). The rate of increase is nearly same to the rate of increase of 0.66% of the peripheral velocity of the rigid roller 7*a* show in FIG. 2(F) when the diameter of the rigid roller 7*a* is supposed to be increased to 12.08 mm which is the diameter 12.00 mm added with the thickness 0.08 mm of the sheet. This means that the value of the diameter of the elastic roller of 16.19 mm at point (E) in FIG. 1 is about equal to the value obtained as the diameter of the elastic roller when its effective peripheral velocity is equal to that of the rigid roller of the diameter added with the thickness of the sheet.

According to the present invention, in a pair of copy sheet transfer rollers composed of a rigid roller pressed to an elastic roller and connected with a driving mechanism so that the peripheral velocity of both the rollers are equal, the diameter of the elastic roller 7*b* is determined between the first diameter at point (C) in FIG. 1 and the second diameter at point (E) in FIG. 1, the first diameter being the corrected diameter of the elastic roller corrected so that the peripheral velocity thereof at the part depressed due to the pressing against the rigid roller is equal to the peripheral velocity of the rigid roller without the copy sheet between the rollers, and the second diameter being the corrected diameter of the elastic roller corrected so that the peripheral velocity thereof at the part depressed due to the pressing against the rigid roller assumed to have a diameter increased by the thickness of the copy sheet is equal to the peripheral velocity of the rigid roller of the diameter added with the thickness of the sheet without the copy sheet between the rollers. The first and second diameters of the elastic roller 7*b* at point (C) and (E) in FIG. 1 are 16.08 mm and 16.19 mm respectively while the theoretical equal-velocity diameter of the elastic roller is 16 mm, i.e., the first and second diameter is respectively 1.005 times and 1.012 times the theoretical equal-velocity diameter (diameter before correction) of the elastic roller.

That is, by determining the diameter of the elastic roller between the diameter at point (C) and that at point (E) in FIG. 1, the sheet feeding velocity varies by only about ±0.1% with a variation of about 0.1 mm in the diameter of the elastic roller 7*b*. As mentioned before, the machining tolerance of the diameter of the elastic roller is ±0.05 mm, and this tolerance can be contained between point (C) and (E) in FIG. 1, so that by determining the design diameter to be a mid-value between point (C) and (E) in FIG. 1, an image forming apparatus capable of feeding the copy sheet with stable velocity and high accuracy can be provided.

Although the sheet of thickness of about 0.08 mm generally used as copy paper is taken up as a sheet in the above explanation, it is evident that the present invention can be applied to the case a thicker or thinner sheet is used. When a plurality of kinds of copy sheets are used, it is suitable to determine the diameter of the elastic roller to correspond with the thickness of the sheet most frequently used or determine the lower limit of the design diameter of the elastic roller to be a dimension near point (C) in FIG. 1. In this way, the apparatus can accommodates a plurality of kinds of sheets.

EFFECT OF THE INVENTION

As has been described in the foregoing, by determining the diameter of said elastic roller in the range between such first diameter that the peripheral velocity of said elastic roller at the part depressed due to the pressing of the elastic roller against the rigid roller without the copy sheet between the rollers coincides with the peripheral velocity of said rigid roller and such second diameter that the peripheral velocity of the rigid roller assumed to have a diameter increased by the thickness of the copy sheet(rigid roller with increased diameter) coincides with the peripheral velocity of the elastic roller at the part depressed due to the pressing of the elastic roller against said rigid roller with increased diameter without the copy sheet between the rollers, the copy sheet can be fed with stable velocity and high accuracy, for the change of the feed velocity of the sheet with the change in the diameter of the elastic roller is small in the range between the first and second diameter of the elastic roller.

Therefore, according to the present invention, an image forming apparatus can be provided in which the copy sheet is fed with stable velocity and high accuracy even if the diameter particularly of the elastic roller varies due to machining tolerance, by determining the medial design value of the diameter of the elastic roller to be about mid-value between the first and second diameter, for the actual diameter of the elastic roller varies between the first and second diameter when tolerance of the diameter is ±0.05 mm which is reasonable tolerance for the elastic roller.

What is claimed is:

1. An image forming apparatus comprising:

a pair of rollers consisting of a rigid roller which is a metal roller or a roller with resin material wound on the periphery thereof and diameter of which is defined as G, and an elastic roller having rubber of hardness of JIS-A Hs65 to 90 wound around the periphery thereof to be depressed with the rigid roller and diameter of which after depression is defined as R;

a group of gears, at least one of which is connected to each of the pair of rollers, each roller's gear engaging the other roller's gear, the group of gears having a gear ratio defined as B/A so that the peripheral velocities of each of the pair of rollers are approximately equal to each other, such that $(B/A)\times(G/R)\approx 1$; and a roller system for transferring a copy sheet by pinching the copy sheet between the pair of rollers by pressing the pair of rollers, with each of the pair of rollers being rotated with approximately the same peripheral velocity by the gear mechanism;

wherein the diameter R' of said elastic roller before depression, from which R is calculated with a reduction rate Q due to the depression by the rigid roller, is set in the range of $R1<R'<R2$;

wherein R1 is a criterial value of a virtual maximum diameter of the elastic roller calculated such that the peripheral velocity of the elastic roller at the part depressed due to the pressing of the elastic roller against the rigid roller coincides with the peripheral velocity of the rigid roller, such that $R1=\{(B/A)\times(G)\}/Q$; and wherein R2 is a criterial value of a virtual minimum diameter of the elastic roller calculated such that the peripheral velocity of the elastic roller at the part depressed due to the pressing of the elastic roller against the rigid roller with increased diameter defined as G+P, where P is the thickness of the copy sheet, coincides with the peripheral velocity of the rigid roller such that $R2=\{(B/A)\times(G+P)\}/Q$.

2. The image forming apparatus according to claim 1, wherein the value of the diameter R' of said elastic roller is determined to be $\{(R1+R2)/2\}$.

3. The image forming apparatus according to claim 1 or 2, wherein said elastic roller is a roller having rubber of hardness of JIS-A Hs70 to 80 wound around the periphery thereof.

4. The image forming apparatus according to claim 1, wherein when the elastic roller is depressed by 0.5% of the diameter R' by the pressing of the elastic roller against the rigid roller, said R1 is 1.005 times the diameter R of the elastic roller and said diameter R2 is 1.012 times the diameter R of the elastic roller.

* * * * *